US008186786B2

(12) United States Patent
Kuriki et al.

(10) Patent No.: US 8,186,786 B2
(45) Date of Patent: May 29, 2012

(54) PRINTER

(75) Inventors: Kumiko Kuriki, Nagoya (JP); Toshio Sugiura, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 481 days.

(21) Appl. No.: 12/128,604

(22) Filed: May 28, 2008

(65) Prior Publication Data

US 2008/0297560 A1 Dec. 4, 2008

(30) Foreign Application Priority Data

May 28, 2007 (JP) ..... 2007-140534

(51) Int. Cl.
*B41J 2/165* (2006.01)

(52) U.S. Cl. ..... 347/8

(58) Field of Classification Search ..... None
See application file for complete search history.

(56) References Cited

U.S. PATENT DOCUMENTS

| | | | | |
|---|---|---|---|---|
| 5,870,114 | A * | 2/1999 | Numata et al. | 347/16 |
| 2004/0061911 | A1* | 4/2004 | Samoto | 358/498 |
| 2004/0246284 | A1 | 12/2004 | Murai et al. | |
| 2005/0152726 | A1 | 7/2005 | Ueda et al. | |

FOREIGN PATENT DOCUMENTS

| | | | |
|---|---|---|---|
| JP | 63209868 | A | 8/1988 |
| JP | 11348248 | A | 12/1999 |
| JP | 2003-266858 | A | 9/2003 |
| JP | 2004-122635 | A | 4/2004 |
| JP | 2004-322515 | A | 11/2004 |
| JP | 2005-014518 | A | 1/2005 |
| JP | 2005-193472 | A | 7/2005 |
| JP | 2005193472 | A | 7/2005 |
| JP | 2006142700 | A | 6/2006 |

OTHER PUBLICATIONS

Japan Patent Office; Notification of Reason for Refusal in Japanese Patent Application No. 2007-140534 mailed May 26, 2009.

* cited by examiner

*Primary Examiner* — Matthew Luu
*Assistant Examiner* — Alejandro Valencia
(74) *Attorney, Agent, or Firm* — Baker Botts L.L.P.

(57) ABSTRACT

A printer includes: a recording head which records an image on a recording medium; a carriage which carries the recording head and is movable in a scanning direction; a guide member which extends in the scanning direction and guides a movement of the carriage in the scanning direction; an angle-controlling member which is supported by the carriage to be pivotable relative thereto and controls an angular position of the carriage relative to the guide member in a state in which at least one contact surface of the angle-controlling member is in contact with a surface of the guide member that extends in the scanning direction; and a pivotal-position adjusting device which adjusts a pivotal position of the angle-controlling member relative to the carriage.

16 Claims, 7 Drawing Sheets

PRINTER

CROSS REFERENCE TO RELATED APPLICATION

The present application claims priority from Japanese Patent Application No. 2007-140534, which was filed on May 28, 2007, the disclosure of which is herein incorporated by reference in its entirety.

BACKGROUND OF THE INVENTION

1. Field of the Invention

The present invention relates to a printer including a recording head that records an image on a recording medium while moving in a scanning direction.

2. Discussion of Related Art

There is known an inkjet printer including: (a) a recording head which ejects droplets of ink toward a recording medium; (b) a carriage which carries the recording head and is movable in a scanning direction; (c) a guide member which extends in the scanning direction and guides a movement of the carriage in the scanning direction. In the inkjet printer, the carriage moves in the scanning direction, guided by the guide member, and the recording head carried by the carriage ejects the droplets of ink toward the recording medium at an appropriate timing, so that an image is recorded on the recording medium such as a recording sheet.

Further, in the above-mentioned inkjet printer, an angular position of the recording head relative to the guide member needs to be adjusted. More precisely, by means of the angular position of the recording head being controlled and determined relative to the guide member, the angular position of the recording head needs to be adjusted relative to the recording medium. Therefore, Patent Document 1 (JP-A-2005-193472), for example, discloses an inkjet printer including a main carriage which is movable in the scanning direction and a sub carriage which carries the recording head, and in which the sub carriage is supported by the main carriage to be pivotable relative thereto.

SUMMARY OF THE INVENTION

As disclosed in Patent Document 1, in a case where the sub carriage is supported by the main carriage to be pivotable relative thereto, a structure of the printer is complicated, so that not only a cost of manufacturing the printer increases, but also a weight of the carriage increases, leading to decreasing of a durability of the carriage (printer). Instead of having the main carriage and the sub carriage, for example, the angular position of the recording head relative to the guide member may be adjusted as follows. A pair of angle-controlling members are pressed against the guide member at two positions distant from each other in an axis direction or a lengthwise direction of the guide member. While one of the pair of angle-controlling members is a non-movable slider fixed to the carriage, the other thereof is a movable slider movable toward and away from the guide member.

However, in the case mentioned above, as described later in detail, respective flat surfaces of the non-movable slider and the movable slider that are opposed to a surface of the guide member are not always held in close contact with the surface of the guide member. Therefore, the movable and non-movable sliders are easily abraded or worn. It is therefore an object of the present invention to provide a printer that can solve this problem without complicating a structure of the printer.

According to the present invention, there is provided a printer comprising: (1) a recording head which records an image on a recording medium; (2) a carriage which carries the recording head and is movable in a scanning direction; (3) a guide member which extends in the scanning direction and guides a movement of the carriage in the scanning direction; (4) an angle-controlling member which is supported by the carriage to be pivotable relative thereto and controls an angular position of the carriage relative to the guide member in a state in which at least one contact surface of the angle-controlling member is in contact with a surface of the guide member that extends in the scanning direction; and (5) a pivotal-position adjusting device which adjusts a pivotal position of the angle-controlling member relative to the carriage.

In the printer in accordance with the present invention, the carriage is movable in the scanning direction) guided by the guide member. The carriage supports the angle-controlling member to be pivotable relative thereto. The angle-controlling member controls or adjusts the angular position of the carriage relative to the guide member in the state in which the at least one contact surface of the angle controlling member is in close contact with the surface of the guide member that extends in the scanning direction. Further, the pivotal position of the angle-controlling member relative to the carriage can be adjusted by the pivotal-position adjusting device. Therefore, an angular position of the recording head which is carried by the carriage can be controlled with a simple structure of the printer. In other words, a posture of the recording head relative to the recording medium that is opposed to the recording head can be controlled or adjusted with a simple structure of the printer.

Moreover, the angle-controlling member is supported by the carriage to be pivotable relative thereto and controls the angular position of the carriage relative to the guide member in the state in which the at least one contact surface of the angle-controlling member is in close contact with the surface of the guide member that extends in the scanning direction, so that the at least one contact surface of the angle-controlling member is kept in close contact with the surface of the guide member, even when the angular position of the carriage is changed. Therefore, an abrasion or wearing of the angle-controlling member is restrained, leading to increasing of a durability of the angle-controlling member. Furthermore, the angle-controlling member can be made of an inexpensive material without a high abrasion resistance.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
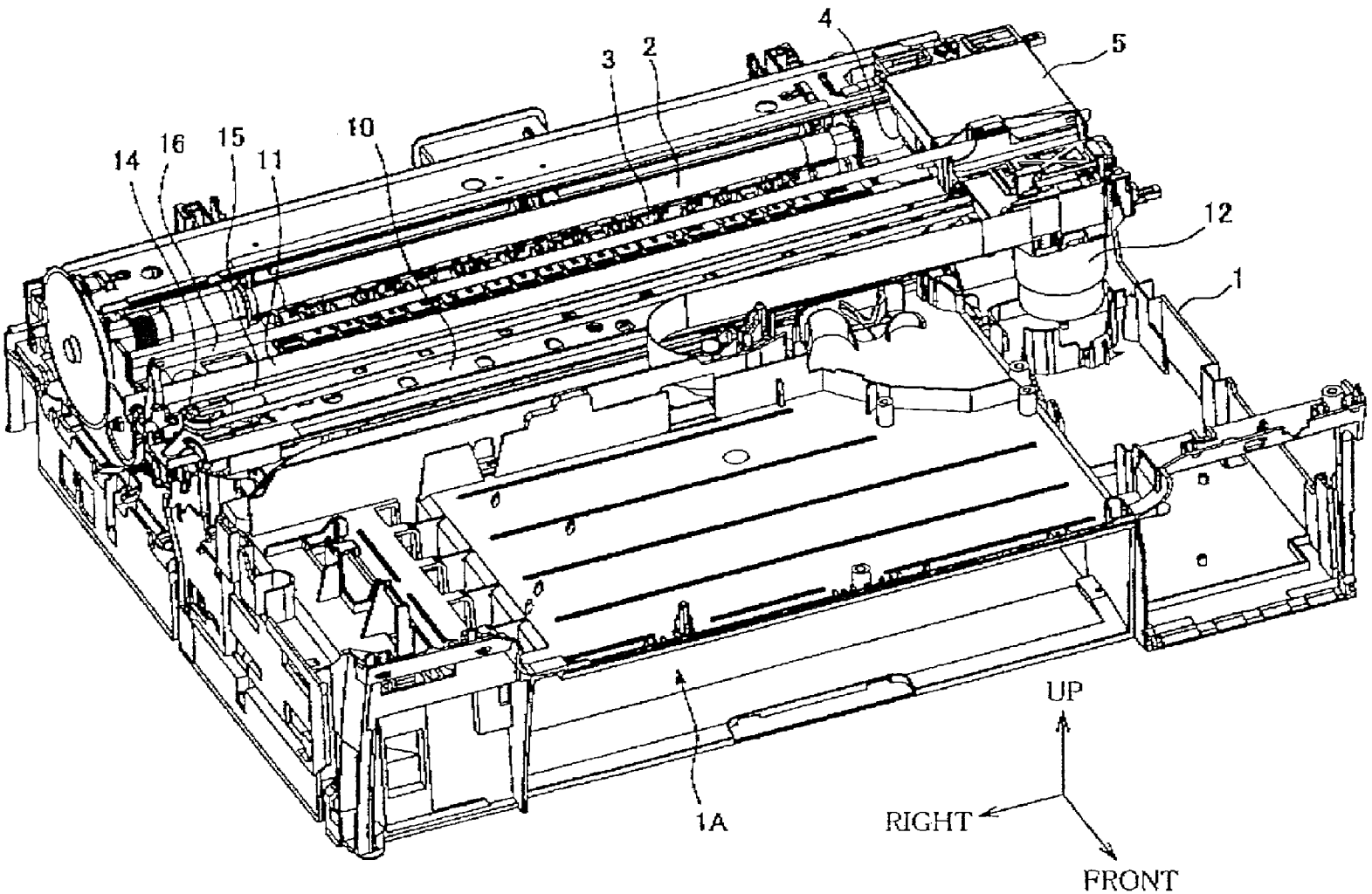
FIG. 1 is a perspective view showing a pertinent structure of an inkjet printer to which the present invention is applied.
Figure 2:
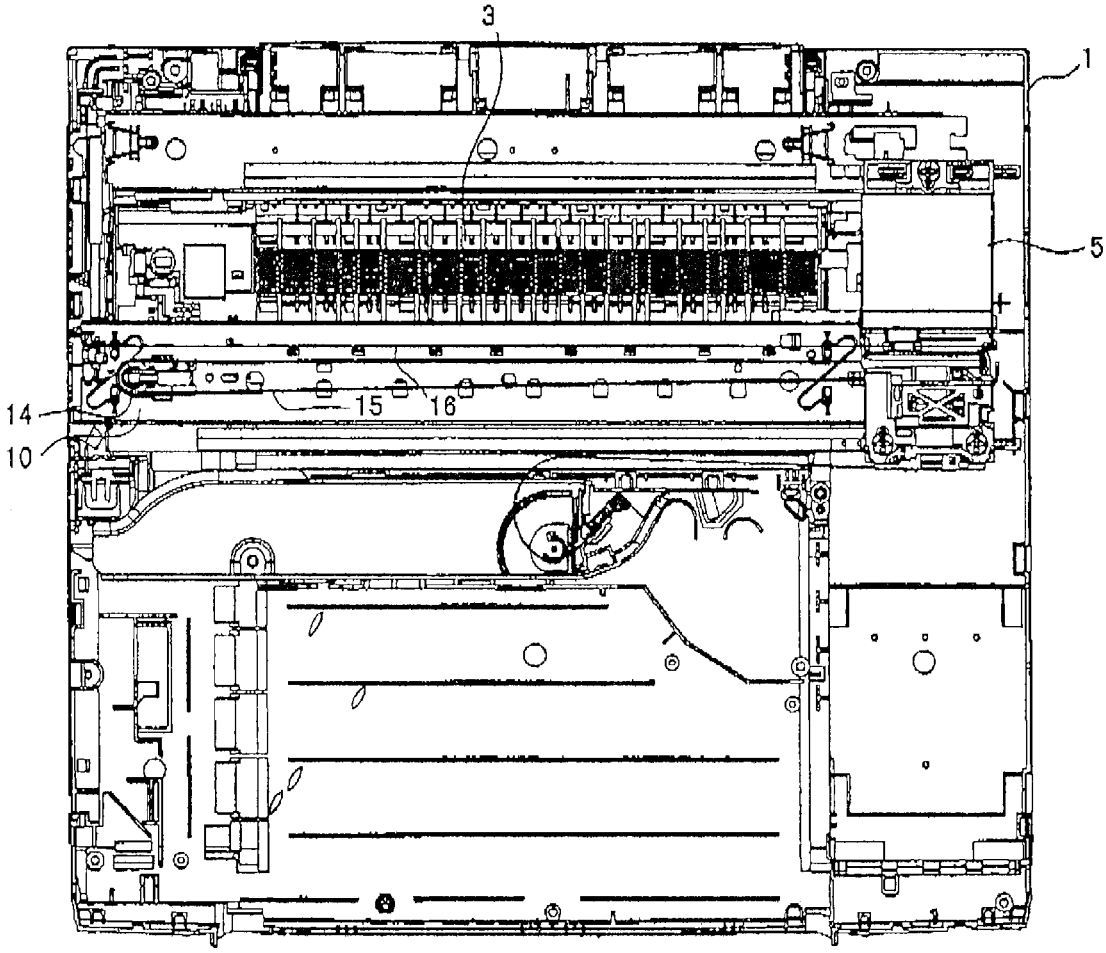
FIG. 2 is a plan view of the pertinent structure of the inkjet printer.

Hereinafter, there will be described preferred embodiments of the present invention with reference to the drawings. As shown in FIG. 1, a lower cover portion 1 of an inkjet printer as an embodiment to which the present invention is applied includes an opening portion 1A that is provided in a lower portion thereof. A sheet tray (not shown) is insertable into or retractable from the opening portion 1A. A recording sheet (not shown) as a recording medium that is accommodated in the sheet tray is conveyed onto a platen 3 through various sorts of rollers including a feeding roller 2. In the following description of each of the components, a direction extending from the feeding roller 2 to the platen 3 will be referred to as a frontward, and a portion, an end, or a side of the each component which is located nearer to the platen 3 relative to the paper feeding roller 2 will be referred to as a front portion, a front end, or a front side of the each component. Also, a portion, an end, or a side of the each component which is located opposite to the platen 3 will be referred to as a rear portion, a rear end, or a rear side of the each component.

Above and in front (ahead) of the platen 3, there is provided a base portion 10 which supports a carriage 5 carrying an inkjet recording head 4 (shown in FIG. 3) as a recording head so as to be movable in a left-right direction in FIG. 1. Hereinafter, the left-right direction of a movement of the carriage 4 will be referred to as a main scanning direction as a scanning direction, and a direction of conveying of the recording sheet onto the platen 3 will be referred to as a sub scanning direction. The inkjet recording head 4 is connected to an ink tank (not shown) via a tube (not shown) such that ink is supplied to the inkjet recording head 4. The inkjet recording head 4 records an image on the recording sheet by ejecting droplets of ink toward the recording sheet from each of a plurality of nozzles that are formed on a nozzle surface of the recording head 4, while moving in the main scanning direction.

The base portion 10 as a base plate member is formed by a press working of a steel flat plate. A rear end of the base portion 10, i.e., a rear side edge of opposite side edges of the base portion 10 extending parallel to the main scanning direction, is bent upright from other portions of the base portion 10, i.e., in a direction perpendicular to and away from a surface of the recording sheet on the platen 3, so as to form a guide plate 11 as a guide member which guides the carriage 5 in the main scanning direction. On an upper surface of the other portion of the base portion 10, there are provided (1) a driving pulley (not shown) which is driven by a motor 12, (2) a driven pulley 14 which is freely rotatable, and (3) a timing belt 15 which is disposed between the driving pulley and the driven pulley 14 and is wound on the pulleys 14. The carriage 5 is fixed to a portion of the timing belt 15, so that the carriage 5 moves in the main scanning direction when the timing belt 15 is driven or circulated by a rotation of the motor 12. Further, above the base portion 10, an encoder strip 16 is disposed for detecting a current position of the carriage 5 based on a sensor (not shown) attached to the carriage 5.

Figure 3:
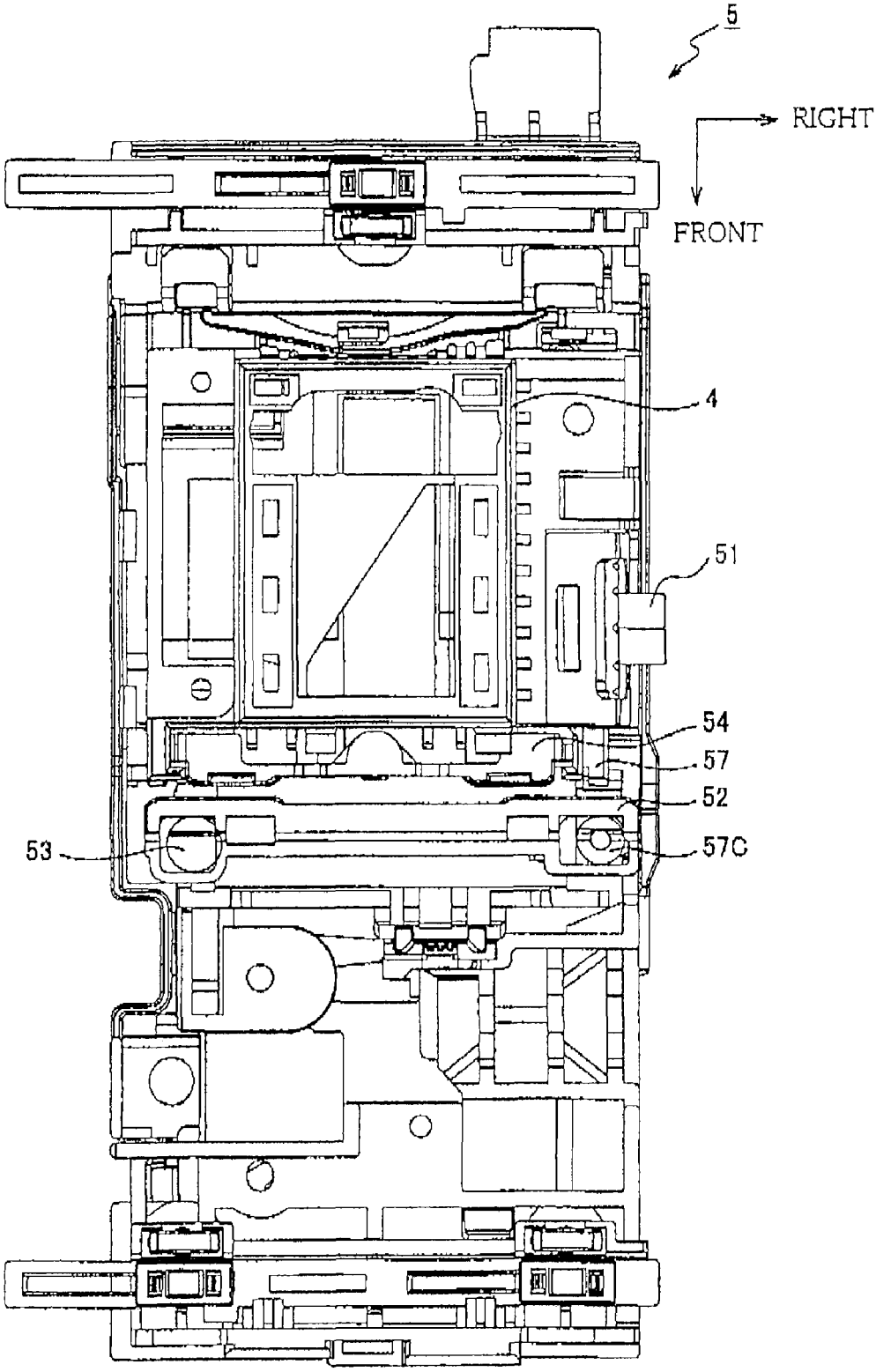
FIG. 3 is a bottom view showing a structure of a carriage of the inkjet printer.

Next, constructions of an angle-controlling member and a pivotal-position adjusting device that are provided on the carriage 5, respectively, will be described in detail. As shown in FIG. 3, on one of opposite sides in the main scanning direction of the carriage 5, on a right-hand side in the present embodiment, there is disposed an adjustment portion 51 which has a regular hexagonal end portion so as to be rotatable by a spanner. On a lower surface (or a surface opposed to the platen 3) of the carriage 5, a movable or pivotable slider 52 as the angle-controlling member is supported by a pivot 53 to be pivotable. The pivot 53 extends downward from the lower surface of the carriage 5. The pivotable slider 52 is pivoted about an axis of the pivot 53 by a pivot movement of the adjustment portion 51, as described later. In the rear of the pivotable slider 62, or on a side of the carriage 5 opposite to the pivotable slider 52 with respect to the guide plate 11 in the sub scanning direction, a pushing or biasing slider 54 as a movable member is disposed for holding (placing) the guide plate 11 under pressure between the pivotable slider 52 and the biasing slider 54. Since the guide plate 11 is held in pressed contact with the sliders 52, 54, an angular position of the inkjet recording head 4 relative to the guide plate 11 is controlled.

Figure 4:
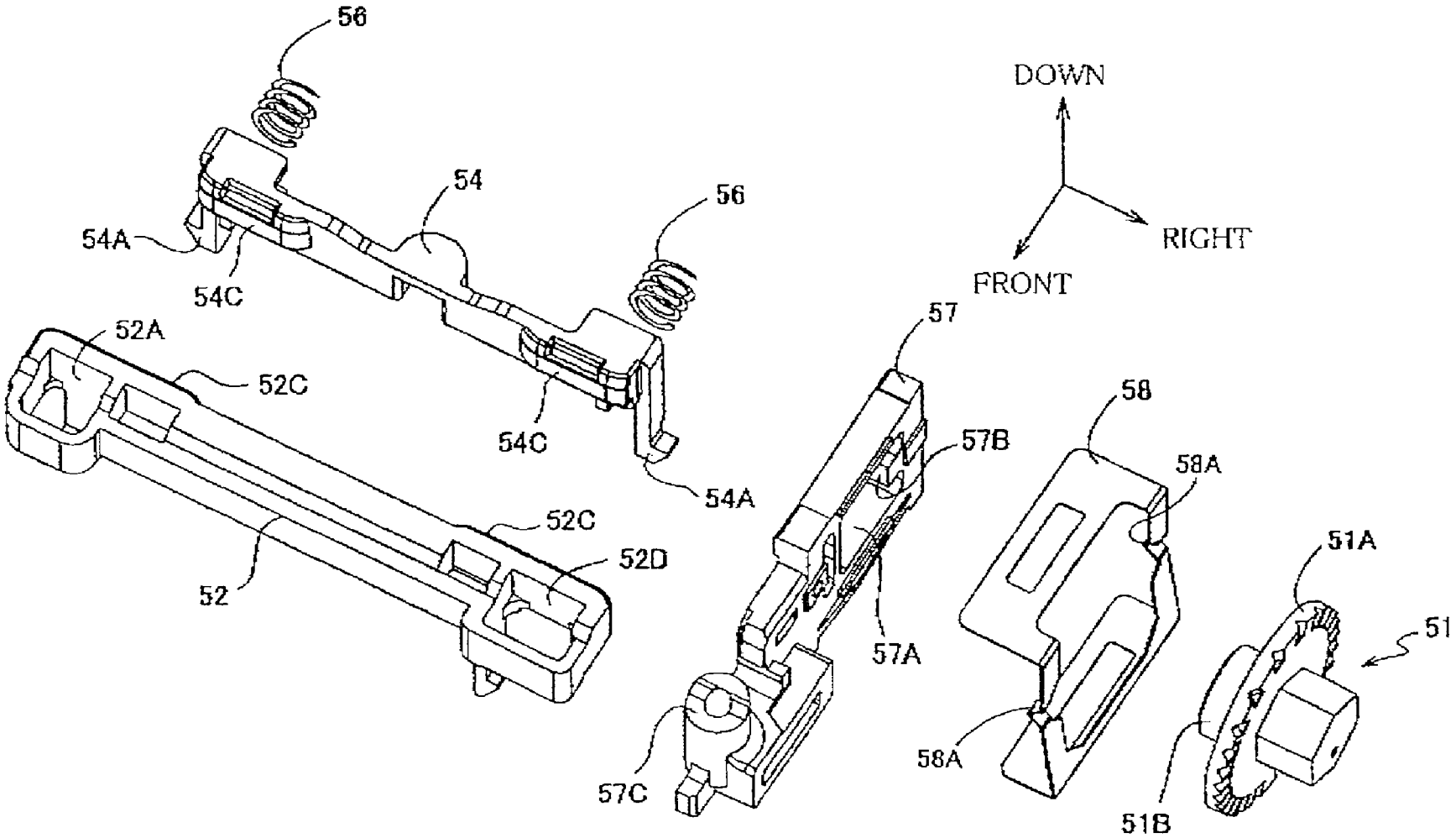
FIG. 4 is an exploded, perspective view of a structure of components of the carriage around a slider.

FIG. 4 shows constructions of the pivotable slider 52 and the biasing slider 54 and other components in the vicinity of the sliders 52, 54. Each of the sliders 52, 54 is formed by molding of a resin that has a preferable sliding performance such as a polyacetal resin or a nylon. The biasing slider 54 is engaged with the carriage 5 by a hook 54A to be slidable in a front-rear direction or in the sub scanning direction. The biasing slider 54 is biased on opposite ends in the main scanning direction of a rear side thereof, or a side opposite to the pivotable slider 52 with respect to the guide plate 11, by a pair of coil springs 56 as one example of a biasing device (member) which are disposed on the carriage 5 such that the pivotable slider 52 and the guide member 11 are held in pressed contact with each other. Instead of the coil springs 56, for example, a rubber may be adopted as a biasing device. The pivotable slider 52 has an opening portion 52A which is disposed in one of opposite end portions thereof in the main scanning direction and which penetrates perpendicularly through a thickness of the pivotable slider 52. The pivot 53 of the carriage 5 fits in the opening portion 52A, such that the pivotable slider 52 is supported by the carriage 5 to be pivotable relative thereto about an pivot axis of the pivot 53 perpendicular to a surface of the recording sheet that is conveyed onto the platen 3, or that is opposed to the inkjet recording head 4. Further, the pivotable slider 52 has a pair of contact surfaces 52C which are provided on a side of the pivotable slider 52 that is opposed to the guide plate 11 and which are located in opposite end portions thereof in the main scanning direction, the pair of contact surfaces 52C being contactable with a surface of the guide plate 11 to be slidable relative thereto. Similarly, the biasing slider 54 has a pair of contact surfaces 54C which are provided on a side of the pivotable slider 52 that is opposed to the guide plate 11 and which are located in opposite end portions thereof in the main scanning direction, the pair of contact surfaces 540 being contactable with the surface of the guide plate 11 to be slidable relative thereto.

The adjustment portion 51 includes: a disk-shaped positioning member 51A which has a plurality of grooves that extend in a radial direction and are formed on a side thereof opposite to an eccentric cam 51B mentioned later; and the eccentric cam 51B that is fixed to the other side of the positioning member 51A to be integrally rotatable with the positioning member 51A. The adjustment portion 51 and a link member 57 are fixed, via a leaf spring member 58, to a right-hand side of the carriage 5, or a side opposite to the pivot 53 of the carriage 5 in the main scanning direction. The link member 57 includes a cam opening 57A in which the eccentric cam 51B fits. The cam opening 57A has a cam supporting surface 57B that is held in contact with the eccentric cam 51B. The leaf spring member 58 is attached to the carriage 5 such that the adjustment portion 51 is rotatable relative to the carriage 5 and the link member 57 is slidable relative thereto in the sub scanning direction or in the front-rear direction. Thus, the link member 57 slides in the sub scanning direction according to a rotation of the adjustment portion 51, and a current rotary position of the adjustment portion 51 is maintained by an engagement of the positioning member 51A and an engaging portion 58A of the leaf spring member 57.

Further, the link member 57 includes an shaft portion 57C that fits in an opening portion 52D which is formed in the other end portion of the pivotable slider 52 in the main scanning direction and which penetrates through a thickness of the pivotable slider 52 perpendicularly. Therefore, when the adjustment portion 51 is rotated such that the link member 57 is slid in the sub scanning direction as mentioned before, the pivotable slider 52 is pivoted about the axis of the pivot 53.

Figure 5:
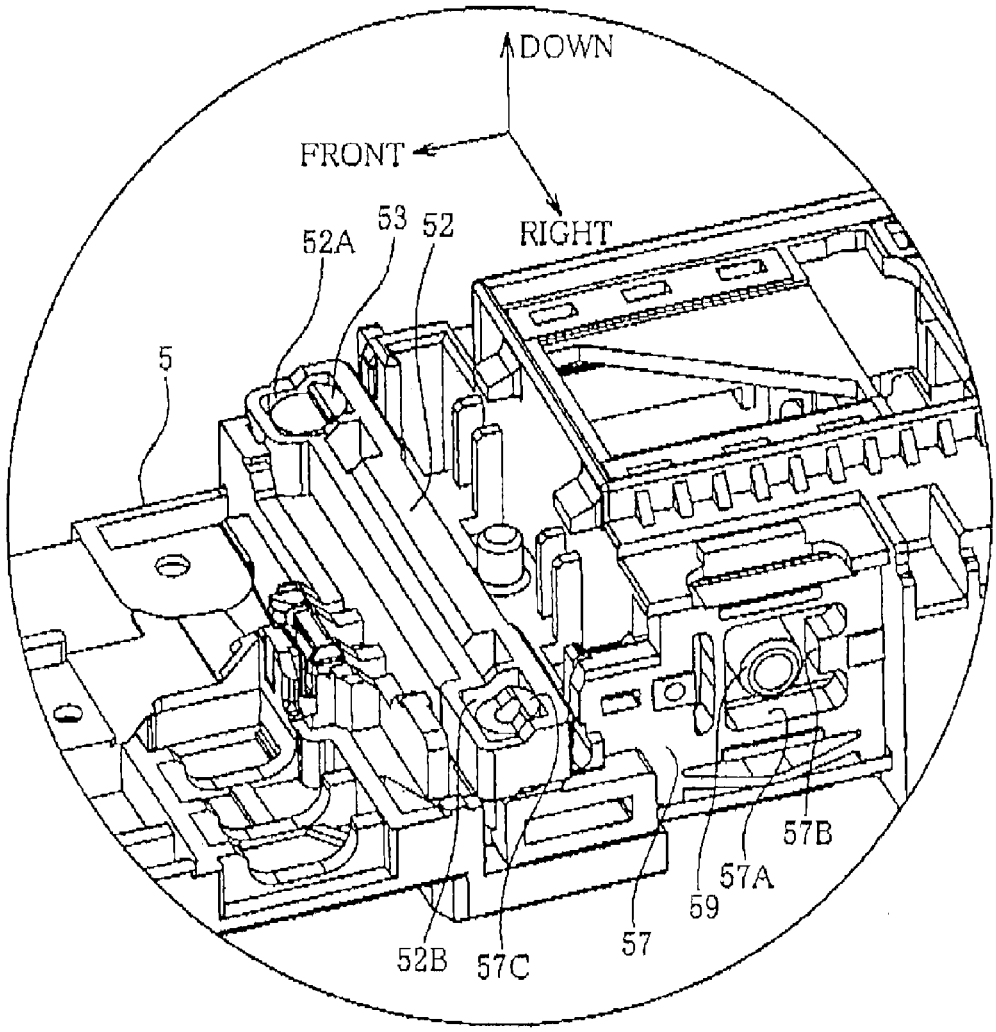
FIG. 5 is an enlarged, perspective view of a structure of components of the carriage around a link member.

FIG. 5 shows a structure of components of the carriage 5 around the link member 57, a portion of the components thereof being omitted. As shown in FIG. 5, when the eccentric cam 51B of the adjustment portion 51 (shown in FIG. 4) is rotated about a rotary axis of an shaft portion 59 which is disposed on the carriage 5 and extends from the right-hand side thereof in the main scanning direction, the link member 57 is slid in the sub scanning direction because the cam supporting surface 573 is held in contact with the eccentric cam 51B, and the pivotable slider 52 is pivoted about the axis of the pivot 53. When the pivotable slider 52 is pivoted about the pivot axis, a right-hand-side one of the pair of coil springs 56, or one of the pair of coil springs 56 that is closer to the adjustment portion 51, is expanded or contracted, so that the biasing slider 54 is also pivoted.

In the present inkjet printer, when the adjustment portion 51 is rotated such that the pivotable slider 52 is pivoted about the pivot axis, an angular position of the inkjet recording head 4 can be controlled. In the present embodiment, a structure of the inkjet printer can be simplified, compared to the conventional inkjet printer that has the main carriage and the sub carriage as disclosed in Patent Document 1. Therefore, in the present embodiment, a manufacturing cost of the inkjet printer can be reduced, and a weight of the carriage 5 is lightened so as to increase a durability of the inkjet printer.

Figure 6A:
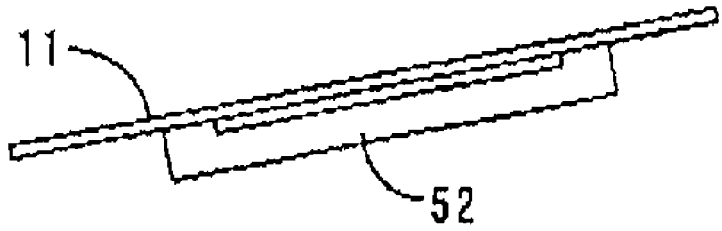
FIG. 6A is an illustrative view showing an effect of the carriage, compared to that of another carriage as a comparative example shown in FIG. 6B.

Furthermore, in the present embodiment, as illustratively shown in FIG. 6A, even when the pivotable slider 52 is pivoted, the pair of contact surfaces 52 of the pivotable slider 52 are kept in contact with the surface of the guide plate 11. In other words, respective contact areas of the pair of contact surfaces 52 and the surface of the guide plate 11 are not decreased (not changed) when the angular position of the inkjet recording head 4 is controlled, so that an abrasion of the pivotable slider 52 is restrained, leading to increasing of a durability of the pivotable slider 52.

Hereinafter, more details will be described. FIG. 7 is a bottom view of a structure of a carriage 150 as a comparative embodiment for controlling a posture of the carriage 150 relative to the guide plate 11 as a guide member that has a flat-plate structure, in which a pair of angle-controlling members are pressed against the guide plate 11 at two positions distant from each other in the main scanning direction, and one of the pair of angle-controlling members is fixed to the carriage while the other thereof is movable toward and away from the guide plate 11. As shown in FIG. 7, on a right-hand side of the carriage 150 which carries the inkjet recording head 4, there is disposed an adjustment portion 151 that is similarly constructed as the adjustment portion 51. When the adjustment portion 151 is rotated about a rotary axis in one direction, a movable slider 152 as the other of the angle-controlling members is moved forward, or toward the guide plate 11. In the vicinity of a left-hand side of the carriage 150, there is disposed a non-movable slider 53 as the one of the angle-controlling members, which is fixed to the carriage 150. On an opposite side of the carriage 150 to the movable slider 152 and the non-movable slider 153 with respect to the guide plate 11, a biasing slider 154 as a movable member is disposed for pressing the guide plate 11 (shown in FIG. 6) against the movable slider 152 and the non-movable slider 153.

An elastic force is applied to the biasing slider 154 by at least one coil spring (not shown) from a rear side thereof so that the movable slider 152; the non-movable slider 153 and the biasing slider 154 hold the guide plate 11 under pressure therebetween. When the adjustment portion 151 is pivoted for controlling a position of the movable slider 152 in the sub scanning direction, an angular position of the carriage 150 carrying the inkjet recording head 4 can be controlled. In the comparative embodiment, a structure of the inkjet printer is simplified, compared to that having the main carriage and the sub carriage, so that the comparative embodiment can enjoy a reduced cost of manufacturing the inkjet printer and also reduced (size and) weight of the carriage 150, leading to an increase of a durability of the carriage 150.

Figure 6B:
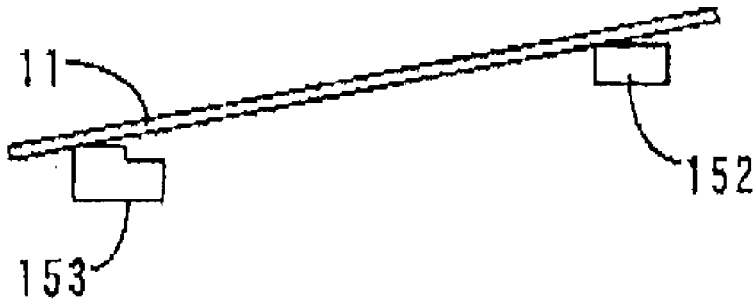
Figure 7:
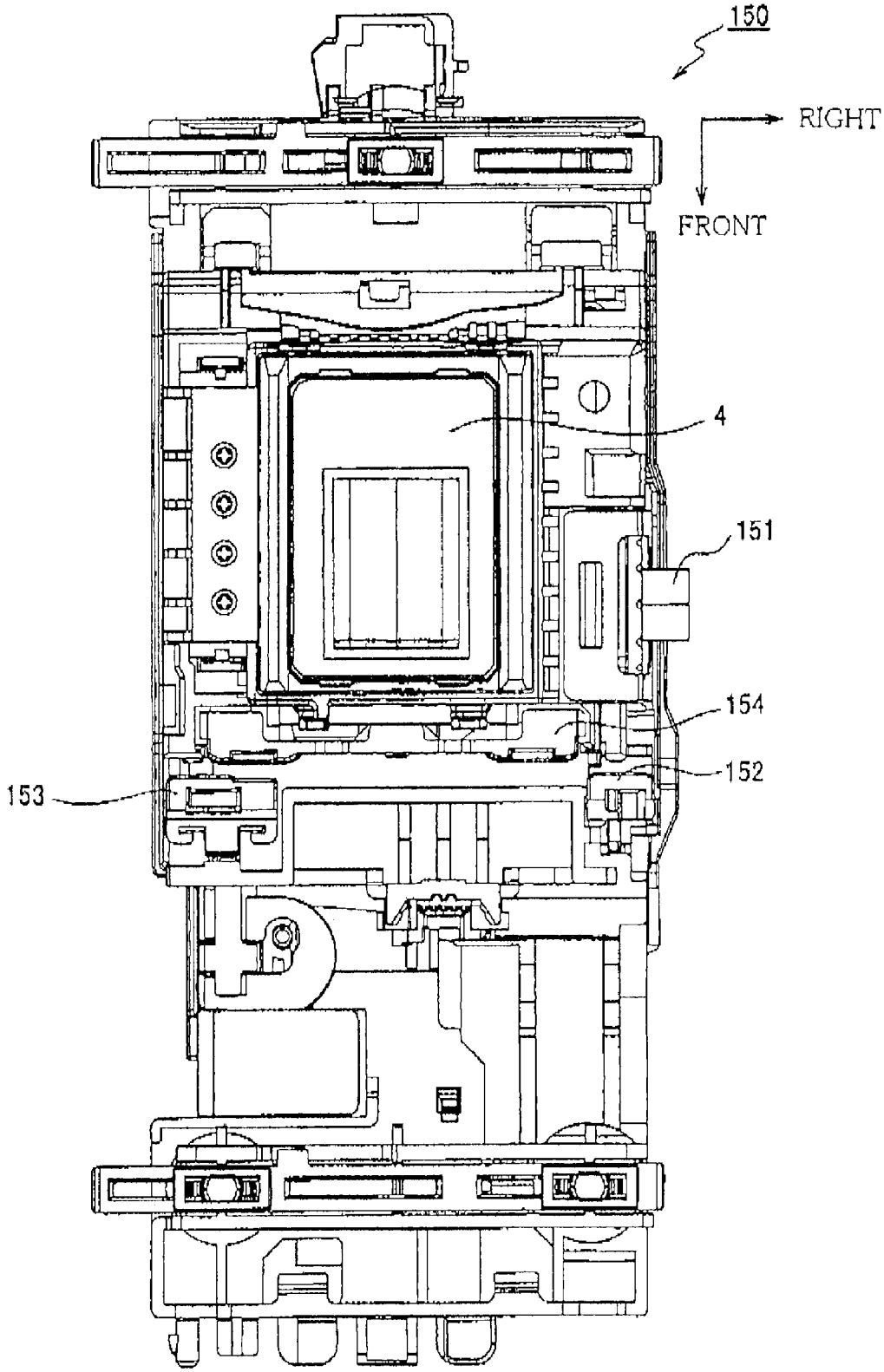
FIG. 7 is a bottom view of a structure of the carriage as the comparative example.

However, in the comparative embodiment, as illustratively shown in FIG. 6B, respective flat contact surfaces of the movable slider 152 and the non-movable slider 153 are not always held in contact with the surface of the guide plate 11, so that the movable slider 152 and the non-movable slider 153 are easily abraded. Therefore, there is a scope left for a further improvement of increasing of the durability of the carriage in the comparative embodiment. According to the present embodiment, in a case where the pivotable slider 52 is pivoted, the contact surfaces 52C of the pivotable slider 52 are kept in contact with the surface of the guide plate 11, so that the abrasion of the pivotable slider 52 is restrained, leading to increasing of the durability of the pivotable slider 52.

As the sliders 152, 153 are abraded, the angular position of the inkjet recording head 4 relative to the guide plate 11 is changed, so that a quality of an image printed on the recording sheet is lowered. Further, as the sliders 152, 153 are abraded, the posture of the carriage 5 during a movement of the carriage 5 guided by the guide plate 11 becomes unstable, so that a quality of an image on the recording sheet is lowered. However, in the present embodiment, since the abrasion of the pivotable slider 52 is restrained as mentioned before, a high quality of an image on the recording sheet is preferably maintained.

Furthermore, the pivotable slider 52 can be made of an inexpensive material without a high abrasion resistance. In the present embodiment, one of opposite ends of the pivotable slider 52 in the main scanning direction is supported by the pivot 53 that extends from the carriage 5, so that a position of the carriage 5 in the sub scanning direction is kept at a base position based on the pivot 53, regardless of the pivotal position of the pivotable slider 52.

The present invention is not limited to the present embodiment. It is to be understood that the present invention may be embodied with various changes and modifications that may occur to a person skilled in the art, without departing from the spirit and scope of the invention defined in the appended claims. For example, a whole or a full length of each of the contact surfaces of the pivotable slider 52 and the biasing slider 54 which extends in the main scanning direction and is opposed to the surface of the guide plate 11 may be held in contact the surface of the guide plate 11. However, as described in the present embodiment, in a case where respective opposite end portions of the pivotable slider 52 and the biasing slider 54 in the main scanning direction are held in contact with the surface of the guide plate 11, the angular position of the recording head 4 can be preferably controlled by using the respective contact surfaces of the pivotable slider 52 and the biasing slider 54 which extend along the guide plate 11, and also, a resistance that acts on the sliders 52, 54 during a movement of the carriage 5 can be limited to a necessity minimum. Further, a pivot axis of the pivotable slider 52 may be provided in a center thereof in the main scanning direction.

Furthermore, in order that the pivotable slider 52 and the guide plate 11 are held in pressed contact with each other, a biasing device (a biasing means) such as the coil spring 56 is not always necessary. For example, in a case where the platen 3 is inclined in the sub scanning direction, the pivotable slider 52 and the guide plate 11 may be held in pressed contact with each other by using a weight of the carriage 5. However, in a case where the biasing device is adopted as described in the present embodiment, the angular position of the inkjet recording head 4 can be maintained at a desired angular position more preferably.

Moreover, in the present embodiment, the angular position of the inkjet recording head 4 is controlled in the state in which the recording head 4 (the carriage 5) is pivoted about the pivot axis that is perpendicular to the surface of the recording sheet. The present invention is applicable to that the recording head 4 is pivoted about a pivot axis, for example, that is parallel to the surface of the recording sheet or that extends in any other directions. However, in a case where the recording head 4 is pivoted about the pivot axis that is perpendicular to the surface of the recording sheet in the present embodiment, an effect that an angular controlling of the recording head 4 has on a quality of image on the recording sheet becomes more remarkable (notable).

Moreover, the guide member may be a cylindrical rod. However, in a case where the guide member comprises the flat plate member as described in the present embodiment, the guide member can have a simple structure, so that a yielding percentage is improved by reducing of producing defective products, and also a manufacturing cost of the inkjet printer can be reduced more effectively.

The present invention is applicable to an inkjet printer including the main carriage and the sub carriage as mentioned in Patent Document 1. In this case, when an angular control of the sub carriage relative to the main carriage is performed as a tough control and an angular control of the main carriage relative to the guide member is performed as a fine control, a structure of a device (a mechanism) that attaches the sub carriage to the main carriage can be simplified.

What is claimed is:

1. A printer comprising:

a recording head which records an image on a recording medium;

a carriage which carries the recording head and is movable in a scanning direction;

a guide member which extends in the scanning direction and guides a movement of the carriage in the scanning direction;

an angle-controlling member which is supported by the carriage to be pivotable relative thereto and controls an angular position of the carriage relative to the guide member in a state in which at least one contact surface of the angle-controlling member is in contact with a surface of the guide member that extends in the scanning direction; and a pivotal-position adjusting device which adjusts a pivotal position of the angle-controlling member relative to the carriage, wherein the carriage includes a pivotal member configured to allow the angle-controlling member to pivot about a pivot axis of the pivotal member, the pivotal member extending from the carriage in a direction perpendicular to a surface of the recording medium in a state in which the recording medium is opposed to the recording head, wherein the angle-controlling member has an opening portion which is disposed in one of opposite end portion thereof in the main scanning direction, and wherein the pivotal member is configured to fit in the opening portion, such that the angle-controlling member is pivotable relative to the carriage.

2. The printer according to claim 1, further comprising a biasing means which biases the carriage in a direction in which the angle-controlling member and the guide member are held in pressed contact with each other.

3. The printer according to claim 2, wherein the biasing means includes a biasing device which is provided on the carriage and which applies a biasing force to the guide member on a side opposite to the angle-controlling member with respect to the guide member so that the angle-controlling member and the guide member are held in pressed contact with each other.

4. The printer according to claim 3, wherein the biasing device includes:

a movable member which is supported by the carriage to be movable toward and away from the guide member and be contactable with the guide member on the side opposite to the angle-controlling member; and an elastic member which is provided between the movable member and the carriage and presses the movable member against the guide member.

5. The printer according to claim 1, wherein the angle-controlling member extending in the scanning direction has a plurality of said contact surfaces comprising at least respective surfaces of opposite end portions of the angle-controlling member in the scanning direction that are in contact with the surface of the guide member.

6. The printer according to claim 5, wherein the angle-controlling member is pivotably attached to the carriage at one of the opposite end portions thereof.

7. The printer according to claim 1, wherein the guide member comprises a flat plate member which is perpendicular to a surface of the recording medium in a state in which the recording medium is opposed to the recording head.

8. The printer according to claim 7, wherein the flat plate member stands from a side edge of a base plate member extending parallel to the surface of the recording medium in the state in which the recording medium is opposed to the recording head, in a direction perpendicular to the surface of the recording medium and away from the recording medium, the side edge of the base plate member extending parallel to the scanning direction.

9. The printer according to claim 1, wherein the pivotal-position adjusting device includes:

a link member which is supported by the carriage to be movable in a direction parallel to the surface of the recording medium in the state in which the recording medium is opposed to the recording head, and which is engaged with a portion of the angle-controlling member that is remote from the pivot axis thereof, such that the link member is pivotable relative thereto about a pivot axis of the link member that is perpendicular to the surface of the recording medium; and an adjusting device which adjusts a position of the link member relative to the carriage.

10. The printer according to claim 9, wherein one of the angle-controlling member and the link member includes a shaft portion which extends in a direction perpendicular to the surface of the recording medium, and an other of the angle-controlling member and the link member includes a recessed portion in which said shaft portion fits to be rotatable relative thereto.

11. The printer according to claim 1, wherein the recording head is attached to the carriage so as to be movable integrally with the carriage.

12. The printer according to claim 1, wherein the recording head comprises an inkjet recording head which is operable to eject droplets of ink toward the recording medium.

13. The printer according to claim 1, wherein the pivotal member is configured to extend from a surface of the carriage.

14. The printer according to claim 1, wherein the angle-controlling member has a length in the scanning direction which is larger than a length of the recording head.

15. The printer according to claim 1, wherein the angle-controlling member has a length in the scanning direction which is approximately the same as a length of the carriage.

16. A printer comprising:

a recording head which records an image on a recording medium;

a carriage which carries the recording head and is movable in a scanning direction;

a guide member which extends in the scanning direction and guides a movement of the carriage in the scanning direction;

an angle-controlling member which is supported by the carriage to be pivotable relative thereto and controls an angular position of the carriage relative to the guide member in a state in which at least one contact surface of the angle-controlling member is in contact with a surface of the guide member that extends in the scanning direction; and a pivotal-position adjusting device which adjusts a pivotal position of the angle-controlling member relative to the carriage, wherein the carriage includes a pivotal member configured to allow the angle-controlling member to pivot about a pivot axis of the pivotal member, the pivotal member extending from the carriage in a direction perpendicular to a surface of the recording medium in a state in which the recording medium is opposed to the recording head, wherein the angle-controlling member has an opening portion, and wherein the pivotal member is configured to fit in the opening portion such that the angle-controlling member is pivotable relative to the carriage.

* * * * *